US007826782B2

(12) United States Patent
Kotera et al.

(10) Patent No.: US 7,826,782 B2
(45) Date of Patent: Nov. 2, 2010

(54) DEVELOPING DEVICE AND IMAGE FORMING APPARATUS

(75) Inventors: Asami Kotera, Osaka (JP); Hiroyuki Hamakawa, Osaka (JP); Akihiro Watanabe, Osaka (JP); Masashi Fujishima, Osaka (JP); Hiroshi Yamazaki, Osaka (JP); Sayo Uemura, Osaka (JP)

(73) Assignee: Kyocera Mita Corporation (JP)

( * ) Notice: Subject to any disclaimer, the term of this patent is extended or adjusted under 35 U.S.C. 154(b) by 69 days.

(21) Appl. No.: 12/331,692

(22) Filed: Dec. 10, 2008

(65) Prior Publication Data

US 2009/0154962 A1 Jun. 18, 2009

(30) Foreign Application Priority Data

Dec. 12, 2007 (JP) ..... 2007-320654

(51) Int. Cl.
*G03G 15/09* (2006.01)

(52) U.S. Cl. ..... 399/276; 399/279; 399/286

(58) Field of Classification Search ..... 399/276, 399/279, 286, 267; 492/18, 53; 430/122.1
See application file for complete search history.

(56) References Cited

U.S. PATENT DOCUMENTS

| | | | | |
|---|---|---|---|---|
| 4,508,052 | A * | 4/1985 | Kohyama | 399/276 X |
| 5,436,102 | A * | 7/1995 | Kubo et al. | 399/276 X |
| 2006/0222982 | A1 * | 10/2006 | Fujikawa | 399/279 X |
| 2008/0069600 | A1 * | 3/2008 | Nakamura et al. | 399/286 |

FOREIGN PATENT DOCUMENTS

| | | |
|---|---|---|
| JP | 2-79062 | 3/1990 |

* cited by examiner

*Primary Examiner*—Sophia S Chen
(74) *Attorney, Agent, or Firm*—Gerald E. Hespos; Michael J. Porco

(57) ABSTRACT

A developing device is provided for visualizing an electrostatic latent image previously formed on the surface of an image carrier as a toner image. The developing device has a developing roller placed at a position facing the image carrier, carrying a toner on the surface thereof, conveying the toner and flying the conveyed toner onto the surface of the image carrier; and a resin layer coated on the surface of the developing roller. The absolute value of the difference in charge between the toners in the upper and lower layers of the toner layer formed on the developing roller as the toner carried on the developing roller is 6 μC/g or less.

21 Claims, 13 Drawing Sheets

DEVELOPING DEVICE AND IMAGE FORMING APPARATUS

BACKGROUND OF THE INVENTION

1. Field of the Invention

The present invention relates to a developing device for use in image forming apparatuses in the electrophotographic process and an image forming apparatus having the developing device.

2. Description of the Related Art

A developing device for use in an image forming apparatus in the electrophotographic process such as copying machines, printers, facsimiles, and multifunctional peripherals (MFPs) in combination thereof forms a toner image by flying toner conveyed by its developing roller to the surface of a photosensitive drum carrying an electrostatic latent image formed based on image data thereon. The image forming apparatus having such a developing device transfers the toner image formed on the photosensitive drum onto a recording medium such as paper. The toner image thus transferred is then fixed on the recording medium as heated in a fixing device. In this way, the image forming apparatus forms an image on the recording medium based on the image data.

Thus, the developing device installed in the image forming apparatus should convey the toner efficiently for example with its developing roller and charge its toner uniformly and reliably in forming a high-quality image.

Developing devices having a developing roller of aluminum that was surface-treated for example by plating or alumite treatment and those having a developing roller of stainless steel are known as conventional developing devices. An example of known developing device of which the charge on the toner is specified is a nonmagnetic mono-component developing device using a toner charged for example by corona charger, wherein at least the surface of the toner conveyer (developing roller) is made of a material containing a charge-controlling agent that is charged in the polarity same as that of the toner and the frictional charge on the toner and that on the material for the toner conveyer have a particular relationship (see JP-A No. 2-79062 and literature D1).

Often in conventional developing devices, more movable toner is supplied preferentially onto the photosensitive drum, leaving less movable toner deposited on the developing roller. Such a state is encountered frequently, in particular when a low-density image is printed, and continued printing for an extended period in the state results in charge up (overcharge) of the toner in the area close to the developing roller, for example by friction of the developing roller or the blade with the toner. Such partial charge up of the toner leads, for example, to deterioration in image density and image blurring, prohibiting printing of high-quality images over an extended period of time.

Specifically, for example, printing by using a toner having a volume-average diameter of approximately 6 μm leads to deposition of one to three toner particles superimposed on the developing roller, forming a toner thin layer having a thickness of approximately 6 to 18 μm. Repeated development leads to accumulation of highly charged small-diameter toner particles on the developing roller, and the toner present in toner surface layer that is more separated from the developing roller is supplied to the photosensitive drum preferentially. In such a case, the following disadvantages emerge.

The highly charged small-diameter toner, which has greater adhesive force to the developing roller, is not used for development, resulting in deterioration in image density. For use of such a highly charged toner in development, the difference in electric potential between the photosensitive drum and the developing roller should be widened for separation of the toner from the developing roller by interaction stronger than the adhesive force. However, increase in the difference in electrical potential between the photosensitive drum and the developing roller leads to electrical leakage between the photosensitive drum and the developing roller, disturbing the toner layer on the developing roller and thus, disrupting the image obtained.

Further in the case of a developing device in the touchdown mode, the toner travelling in the developing region occasionally remains deposited on the developing roller because of strong adhesive force in the developing device, even though it should be separated once from the developing roller. The toner remaining deposited on the developing roller is charged up to a greater amount, thus prohibiting printing of high-quality images even in the case of a developing device in the touchdown mode.

In literature D1, the charge on the toner deposited on the developing roller is specified in relationship with the frictional charge on the material for developing roller, but distribution of the charge of toner is not controlled at all. In such a case, the toner held on the developing roller, in particular the toner closer to the developing roller, is charged up. It may thus lead to insufficient image density and image blurring, prohibiting printing of high-quality images over an extended period of time.

SUMMARY OF THE INVENTION

An object of the present invention is to provide a developing device charging the toner uniformly and reliably and giving high-quality images over an extended period of time and an image forming apparatus having the developing device.

An aspect of the present invention, which achieved the object, is a developing device visualizing an electrostatic latent image previously formed on the surface of an image carrier as toner image, comprising: a developing roller placed at a position facing the image carrier, carrying a toner on the surface thereof, conveying the toner and flying the conveyed toner onto the surface of the image carrier; and a resin layer coated on the surface of the developing roller, wherein the absolute value of the difference in charge between the toners in the upper and lower layers of the toner layer formed on the developing roller as the toner is carried on the developing roller is 6 μC/g or less.

Another aspect of the present invention is a developing device visualizing an electrostatic latent image previously formed on the surface of an image carrier as toner image, comprising: a magnetic roller carrying and conveying a two-component developer containing a toner and a carrier; a developing roller placed at a position facing the image carrier and the magnetic roller that carries the toner in the two-component developer on the surface in contact with or in close proximity to the two-component developer conveyed by the magnetic roller, conveys and flies the conveyed toner onto the surface of the image carrier; and a resin layer coated on the surface of the developing roller, wherein the absolute value of the difference in charge between the toners in the upper and lower layers of the toner layer formed on the developing roller as the toner is carried on the developing roller is 6 μC/g or less.

DETAILED DESCRIPTION OF THE PREFERRED EMBODIMENTS

Hereinafter, the developing device according to the present invention and the image forming apparatus having the developing device will be described in detail with reference to drawings. The image forming apparatus will be described, for example, as a copying machine, but is not limited thereto, and may be, for example, a facsimile device or a printer. In addition, the image carrier will be described by taking a drum-shaped photosensitive body (photosensitive drum) as an example, but is not limited thereto, and may be, for example, a belt- or sheet-shaped photosensitive body.

First Embodiment

Figure 1:
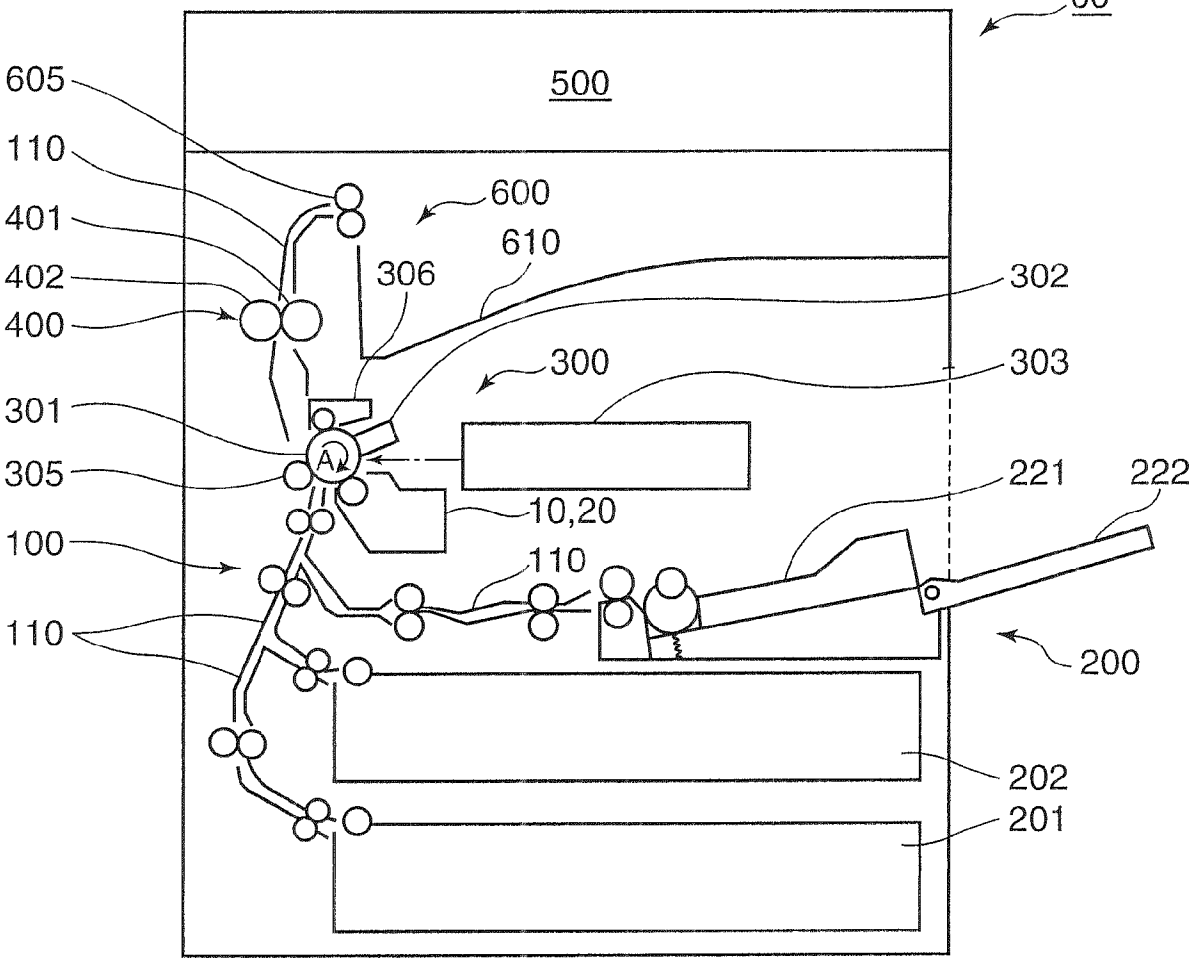
FIG. 1 is a schematic view illustrating an image forming apparatus (copying machine) 60 to which the developing device in an embodiment of the present invention is applied.

FIG. 1 is a schematic view illustrating the configuration of an image forming apparatus (copying machine) 60 having a developing device in an embodiment of the present invention. The copying machine 60 is a so-called internally paper-feeding copying machine having a paper-feeding unit 200 disposed in the lower region of a copying machine main body, an image forming unit 300 disposed above the paper-feeding unit 200, a fixing unit 400 disposed downstream of the image forming unit 300, an image-reading unit 500 disposed in the upper region of the copying machine main body, and a paper discharge unit 600 disposed between the copying machine main body and the image-reading unit 500. The copying machine main body has a paper-conveying unit 100 for connection of the paper-feeding unit 200, the image forming unit 300, the fixing unit 400, and the paper discharge unit 600.

The image forming unit 300, which forms a particular toner image on paper by electrophotography process, has a photosensitive drum 301 rotatably supported by a shaft, as well as a charging unit 302, an light exposure unit 303, developing units (developing devices) 10 and 20, a transfer unit 305, and a cleaner 306 that are disposed on the periphery of the photosensitive drum 301 in the revolving direction A. The developing units 10 and 20 develop the electrostatic latent image with toner and form a toner image on the surface of the photosensitive drum 301.

The fixing unit 400, which is disposed downstream of the image forming unit 300 in the paper conveying direction, heats the paper carrying the toner image transferred thereon in the image forming unit 300 with a pair of rollers (heating roller 401 and pressure roller 402) and fixes the toner image on the paper.

The image-reading unit 500 reads the image information on document by irradiating the document placed on a contact glass with the light from an exposure lamp and guiding the reflected light from reflector into a photoelectric conversion unit.

The paper-feeding unit 200 has multiple paper-feeding cassettes 201, 202 and 221. The paper-feeding cassette 221 among them is a bypass tray feeding paper from the side of the copying machine, and can be closed with a cover unit 222.

Each paper-feeding cassette 201, 202 or 221 is connected to the paper-conveying route 110, and the paper-conveying route 110 extends, via the image forming unit 300 and the fixing unit 400, to the paper discharge unit 600. This paper-conveying route 110 constitutes the paper-conveying unit 100. The paper after copying is then discharged by the discharge roller 605 in the paper discharge unit 600 onto the discharge tray 610.

Figure 2:
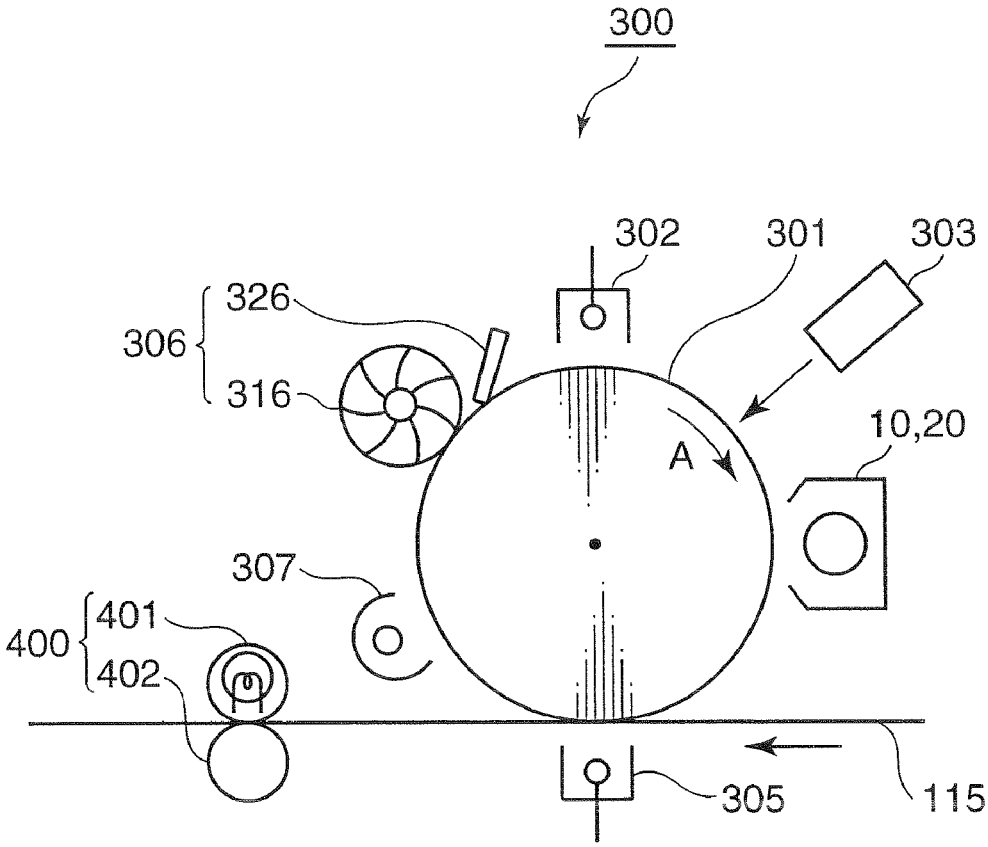
FIG. 2 is a schematic view illustrating the region around the image forming unit 300 of the copying machine 60.

FIG. 2 is a schematic view illustrating the area close to the image forming unit 300 of the copying machine 60. The image forming unit 300, which is a unit forming a particular toner image on a recording paper 115 by electrophotography process, has a charging unit 302, an light exposure unit 303, developing units 10 and 20, a transfer unit 305, a charge eliminator unit 307, and a cleaner 306 disposed on the periphery of the photosensitive drum 301 in the revolving direction A of the photosensitive drum 301. The charge eliminator unit 307 and the cleaner 306 may be disposed at reversed positions.

The charging unit 302 generates a particular electric potential on the surface of the photosensitive drum 301 by corona discharge. The light exposure unit 303 weakens the potential on the surface of the photosensitive drum 301 selectively by irradiating the light corresponding to a desired image and forms an electrostatic latent image thereon. Each of the developing units 10 and 20 develops the electrostatic latent image formed on the surface of the photosensitive drum 301 with a toner and forms a toner image, and is, for example, a magnetic mono-component development device or a developing device in the touchdown mode, as will be described below. The transfer unit 305 transfers the toner image formed on the photosensitive drum 301 onto a recording paper 115. The charge eliminator unit 307 eliminates the surface charge of the photosensitive drum 301 by irradiation with lamp light. The cleaner 306 consisting of a fur brush 316 and a rubber blade 326 removes the toner, its additives and others remaining on the surface of the photosensitive drum 301. The cleaner 306 exemplified in Figure has both a fur brush 316 and a rubber blade 326, but there is also a case where the cleaner 306 has only one of them.

The recording paper 115 carrying the toner image transferred in the image forming unit 300 is heated under pressure in the fixing unit 400 (by heating roller 401 and pressure roller 402), giving a fixed toner image, and then, discharged by a paper discharge roller (not shown in the figure) onto the paper discharge tray.

A apparatus transferring a toner image directly on paper is shown above as the image forming apparatus, but the device is not limited to such an image forming apparatus. It may be, for example, a so-called tandem image forming apparatus of transferring multiple color toner images one by one on an intermediate transfer belt and retransferring the multiple color toner images transferred onto the intermediate transfer belt.

Hereinafter, the developing unit (developing device) 10 in the first embodiment of the present invention to be installed in the copying machine 60 above will be described. The developing device 10 is a device having a developing roller 14 coated with a resin layer, characterized in that the absolute value of the difference in charge between the toners in the upper and lower layers of the toner layer formed on the developing roller 14 as the toner is carried on the developing roller is 6 μC/g or less.

Figure 3:
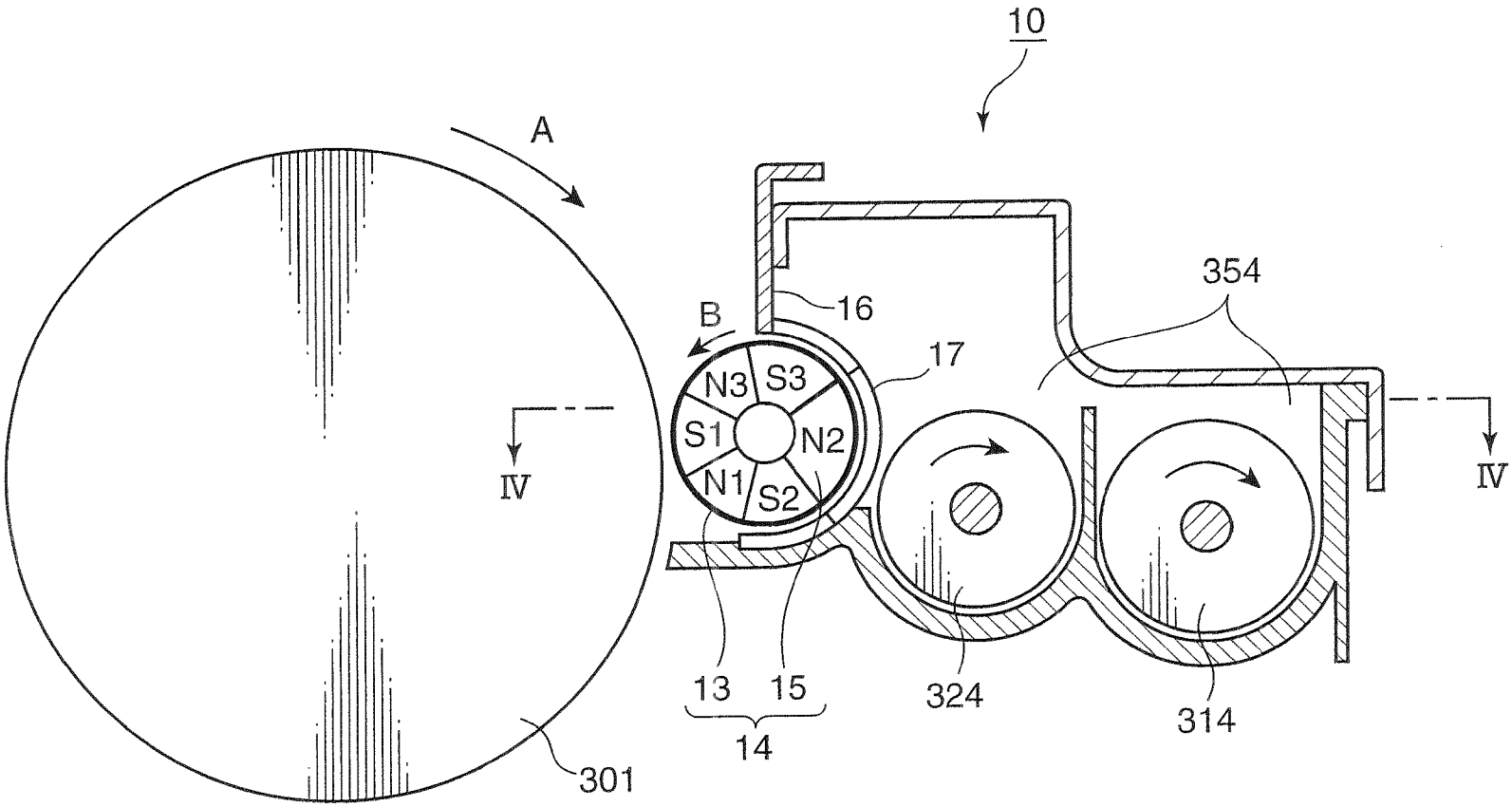
FIG. 3 is a schematic cross-sectional view illustrating the developing unit (developing device) 10 in the first embodiment of the present invention.
Figure 4:
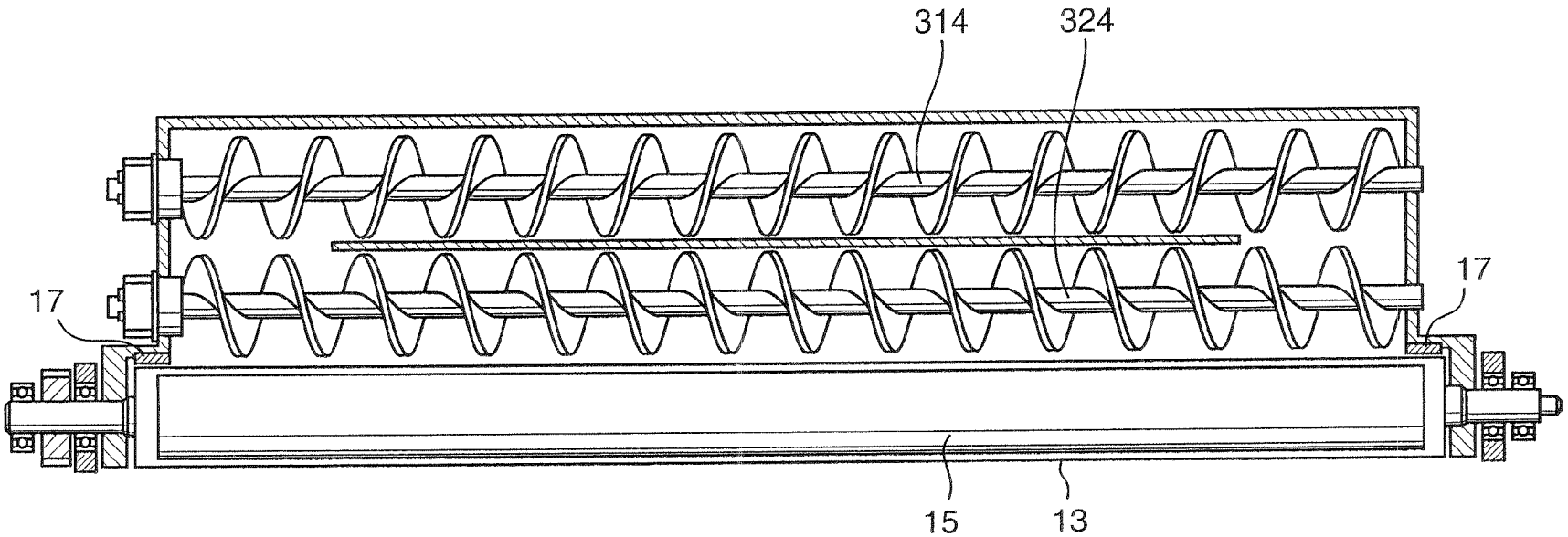
FIG. 4 is a schematic cross-sectional view illustrating the developing unit (developing device) 10 shown in FIG. 3, as seen along the cutting line IV-IV.

The developing device 10 is a developing device in the magnetic mono-component developing mode. FIG. 3 is a schematic cross-sectional view illustrating the developing unit (developing device) 10 in the first embodiment of the present invention with the photosensitive drum 301. Alternatively, FIG. 4 is a schematic cross-sectional view of the developing unit (developing device) 10 shown in FIG. 3, as seen along the cutting line IV-IV.

The developing unit 10 has toner containers 354 containing a magnetic mono-component developer (toner) not shown in the Figure, two agitating members 314 and 324 agitating the toner, a developing roller 14 transferring the toner onto the surface of the photosensitive drum 301.

The developing roller 14 has a cylindrical revolving sleeve 13 and a fixed magnet 15 contained in the revolving sleeve 13, and the revolving sleeve 13 revolves around the periphery of the fixed magnet 15 while it is fixed at its position. A blade 16 is formed, as it faces the revolving sleeve 13 of the developing roller 14.

The fixed magnet 15 is a magnet of the 6-pole structure with the magnetic pole disposed as follows. The S pole (development pole S1) is disposed at the position facing the photosensitive drum 301, while another S pole (blade pole S3) at the position facing the blade 16. The N pole (N1), the S pole (S2), and the N pole (N2) are sequentially disposed downstream of the development pole S1 in the revolving direction B of the revolving sleeve 13 and the N pole (N3) is disposed downstream of the blade pole S3 in the revolving direction B of the revolving sleeve 13.

Hereinafter, operation of the developing unit 10 will be described.

The developing unit 10 charges the toner, while conveying and agitating the toner with the agitating members 314 and 324. The agitating member 324 feeds the charged toner to the developing roller 14. The toner fed to the developing roller 14 is attracted by the magnetic force from the N2 and N3 poles of the fixed magnet 15, conveyed upward by revolution of the revolving sleeve 13 to the layer thickness-adjusting position by blade 16 and then past the layer thickness-adjusting position. In this way, the thickness of the toner layer is adjusted. The toner conveyed close to the photosensitive drum 301 migrates to the photosensitive drum 301.

By the operation above, the developing device 10 forms an image, based on the electrostatic latent image formed on the photosensitive drum 301. An example of the development condition of the developing device 10 in the first embodiment will be described below: The photosensitive drum 301 for use is a photosensitive drum having a diameter of 80 mm; the developing roller 14 for use is a developing roller having a diameter of 25 mm; and the peripheral speeds of the photosensitive drum 301 and the developing roller 14 are adjusted respectively to 240 and 360 mm/sec. The gap between the photosensitive drum 301 and the developing roller 14 is adjusted to 300 μm. The latent image region (exposed region, image forming region) on the photosensitive drum 301 has an electric potential of 20 V, while the non-latent image region (unexposed region, non-image forming region) an electric potential of 350 V. The developing bias voltage (bias voltage applied to developing roller 14) is superposed voltage obtained by superposing DC and AC voltages. Specifically, the DC voltage (Vdc) is set to 250 V. The AC peak-to-peak value (Vpp) is set to 1.6 kV; the AC frequency (f) to 3.5 kHz; and the AC positive duty ratio (duty) to 50%.

The blade 16 has a pair of magnetic parts 17 disposed at the position of the toner container 354 side of the developing roller 14, as they face the peripheral surface of the developing roller 14. The magnetic parts 17, which are aimed at preventing movement of the toner from the central peripheral region to the terminals of the developing roller 14 before the toner reaches the blade 16, are formed in the circular arc shape having a curvature central angle of approximately 180° along the peripheral surface of the developing roller 14.

Figure 5A:
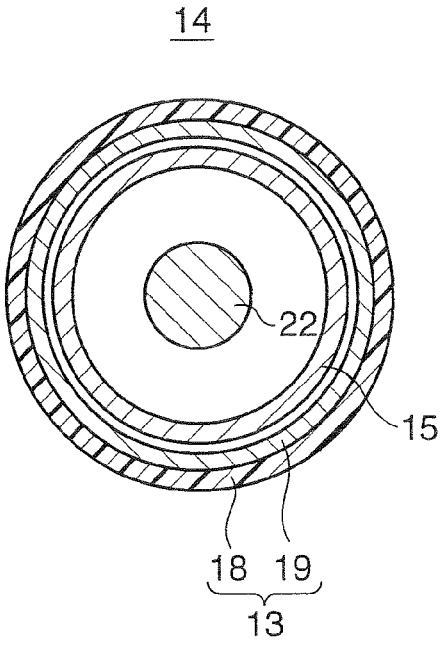
FIG. 5A is a schematic cross-sectional view illustrating an example of the developing roller 14 installed in the developing device 10 of a magnetic mono-component development device.
Figure 5B:
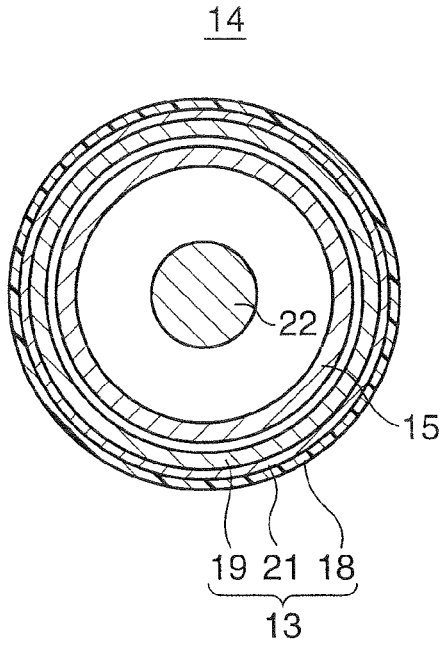
FIG. 5B is a schematic cross-sectional view illustrating another example of the developing roller 14 installed in the developing device 10 of a magnetic mono-component development device.
Figure 5C:
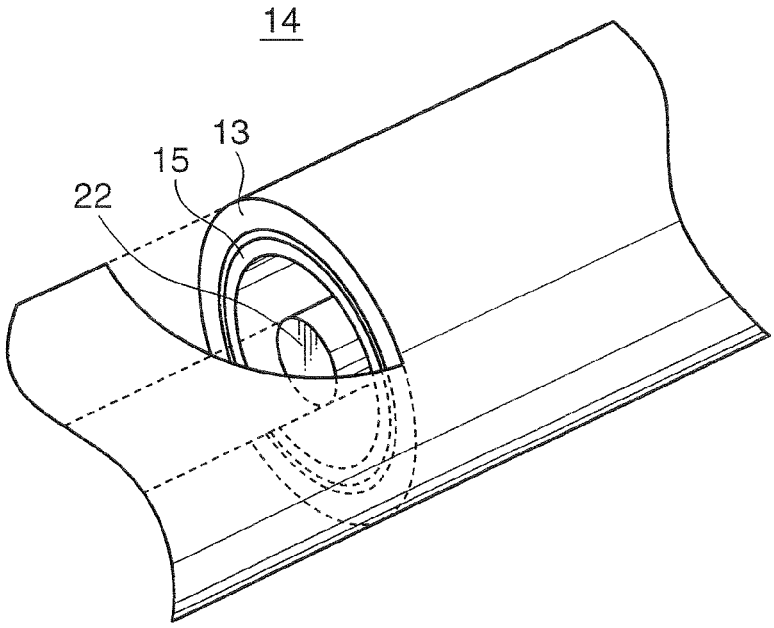
FIG. 5C is a partial cross-sectional view of the developing roller 14 installed in the developing device 10 of a magnetic mono-component development device, as its peripheral region is partially cut off.

Hereinafter, the developing roller 14 used in the developing unit 10 will be described. FIG. 5A is a cross-sectional view illustrating an example of the developing roller 14 installed in the developing device of the magnetic mono-component development device 10. FIG. 5B is a cross-sectional view illustrating another example of the developing roller 14 installed in the developing device 10 of the magnetic mono-component development device. FIG. 5C is a partial cross-sectional view illustrating the developing roller 14 installed in the developing device 10 of the magnetic mono-component development device, as part of the developing roller is removed.

As shown in FIG. 5C, the developing roller 14 has a cylindrical revolving sleeve 13 and a magnet 15 fixed in the revolving sleeve 13, and has a configuration in which the revolving sleeve 13 revolves around the periphery while the fixed magnet 15 is held still at the position.

As shown in FIG. 5A, the revolving sleeve 13 has a base plate 19 and a resin layer 18 coated thereon. The base plate 19 is, for example, a cylindrical member of aluminum, stainless steel or the like. Also as shown in FIG. 5B, the base plate 19 may have a surface-finished layer 21 additionally formed on the surface side of the resin layer 18 coated. The surface-finished layer 21 is, for example, an electroplated layer, an alumite layer or the like. The fixed magnet 15 is connected to the shaft 22 supported by the developing unit 10 with multiple ribs.

The resin layer 18 is not particularly limited, if the toner carried on the revolving sleeve 13 of the developing roller 14 gives a toner layer having an absolute value of the difference in charge between the toners in the upper and lower layers of 6 μC/g or less, and the resin is preferably, for example, a silicone-modified urethane resin. The resin in the resin layer 18 preferably has a volume resistivity in the range of $10^5$ to $10^7\Omega$.

The thickness of the resin layer 18 is preferably 5 to 50 μm, more preferably 10 to 30 μm. When the base plate 19 does not have a surface-finished layer 21 as shown in FIG. 5A, the thickness of the resin layer 18 is set, for example, to 25 μm, while, when the base plate 19 has a surface-finished layer 21 as shown in FIG. 5B, the thickness of the resin layer 18 is set to a thickness smaller than that without a surface-finished layer 21, for example to 15 μm. In this way, when the base plate 19 has a surface-finished layer 21, even if the thickness of the resin layer 18 is made thinner than that with a surface-finished layer 21, it is possible to adjust the charge on the toner carried on the revolving sleeve 13 in the range above. Thus, when the base plate 19 has a surface-finished layer 21, even if the thickness of the resin layer 18 is made smaller, it is possible to reduce the absolute value of the difference in charges between the toners in the upper and lower layers.

The toner charge is determined by using a suction Faraday cage. Specifically, the charge on the toner in the upper layer is determined by measuring the toner sample collected from the upper toner layer, and the charge on the toner in the lower layer balance, by measuring the toner sample collected from the remaining toner. The suction Faraday cage for use is, for example, a QM meter (MODEL210S) manufactured by TREK. The upper-layer toner is the toner (toner layer) carried on the developing roller closer to the surface in a amount of 50 to 70 mass % of the entire toner carried on the developing roller, and the lower-layer toner is the toner closer to the development roller than the upper-layer toner. The toner layer for measurement of the charge is, for example, is the toner layer after stabilized operation of the developing device and also after printing of an image having a printing rate of 3% continuously on 10 sheets (A4 sized).

The silicone-modified urethane resin described above is prepared, for example, by hardening a resin composition including an urethane resin (A) containing at least one alkenyl group allowing hydrosilylation reaction in the molecule and a silicon-containing compound (B) containing at least two hydrosilyl groups in the molecule. Thus, the silicone-modified urethane resin is a hardened product of the resin obtained in reaction of the at least one alkenyl group allowing hydrosilylation reaction contained in the molecule of the urethane resin (A) and the at least two hydrosilyl groups in the molecule of the silicon-containing compound (B). The resin composition may contain, as needed, a hydrosilylation catalyst (C) and a conductivity-enhancing agent (D).

The urethane resin (A) may be used without particular limitation, if it has at least one alkenyl group allowing hydrosilylation reaction in the molecule, but is preferably a resin having the alkenyl groups allowing hydrosilylation reaction on the side chains. The mass-average molecular mass of the urethane resin (A) is preferably 10000 to 150000. The mass-average molecular mass is determined by gel-permeation chromatography (GPC).

The alkenyl group contained in the molecule of the urethane resin (A) is not particularly limited, if it is a group containing a carbon-carbon double bond reactive in the hydrosilylation reaction. Typical examples of the alkenyl groups include aliphatic unsaturated hydrocarbon groups such as vinyl, allyl, methylvinyl, propenyl, butenyl, pentenyl and hexenyl; cyclic unsaturated hydrocarbon groups such as cyclopropenyl, cyclobutenyl, cyclopentenyl and cyclohexenyl; a methacryl group, and the like. Among them, aliphatic unsaturated hydrocarbon groups are preferable.

The silicon-containing compound (B) may be used without any particular limitation, if it has at least two hydrosilyl groups in the molecule, but, for example, an organohydrogen polysiloxane having at least two hydrosilyl groups in the molecule is preferable.

The blending rate of the silicon-containing compound (B) is preferably 0.1 to 100 parts by mass, more preferably 1 to 50 parts by mass as solid matter, with respect to 100 parts by mass of the solid matter in the urethane resin (A). Excessive decrease in the blending rate of the silicon-containing compound (B) leads to deterioration in release characteristics and thus in toner printing efficiency, while excessive increase thereof to deterioration in conductivity of the resin layer 18, difficulty in eliminating the charge generated by rubbing of the toner, and thus deterioration in toner printing efficiency.

The hydrosilylation catalyst (C) can be used without any limitation, if it can accelerate the hydrosilylation reaction and does not impair the advantageous effects of the present invention, and is, for example, a platinum (Pt) complex compound or the like.

The conductivity-enhancing agent (D) can be used without any limitation, if it can adjust the volume resistivity of the resin and does not impair the advantageous effects of the present invention, and is, for example, a carbon black such as acetylene black, furnace black, or lamp black, or the like, and acetylene black is used favorably. Carbon blacks having a primary particle diameter of 10 to 60 nm are preferable, and those of about 48 nm are used more favorably. The blending rate of carbon black is preferably 1 to 20 mass %, for example about 16 mass %, with respect to the resin.

The developing roller 14 is produced, for example, by applying the resin composition on a base plate 19 under heat and thus forming a resin layer 18 thereon. The resin composition may applied as a solution, as it is prepared by addition of a solvent, for uniform coating on the base plate 19. The solid matter concentration then is preferably adjusted to 20 to 40 mass %. Examples of the solvents include cyclohexane, methylethylketone and the like. The heating temperature is preferably 100 to 160° C., and the heating period is preferably, for example, 20 to 40 minutes.

Figure 6A:
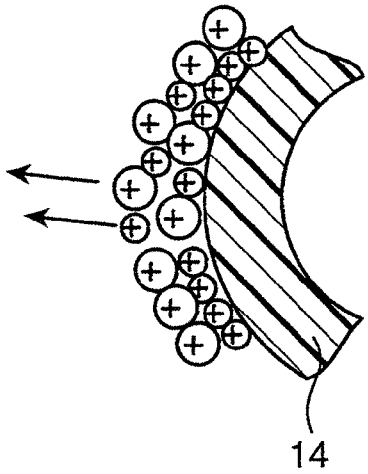
FIG. 6A is a schematic view illustrating the behavior of the toner on developing roller before flying of the toner from the developing roller 14 to the photosensitive drum in the developing device 10 of the first embodiment.
Figure 6B:
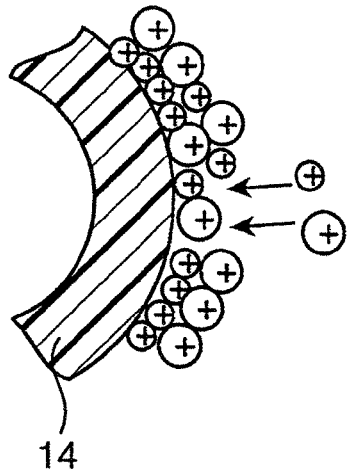
FIG. 6B is a schematic view illustrating the behavior of the toner on the developing roller after flying of the toner from the developing roller 14 to the photosensitive drum in the developing device 10 of the first embodiment.
Figure 6C:
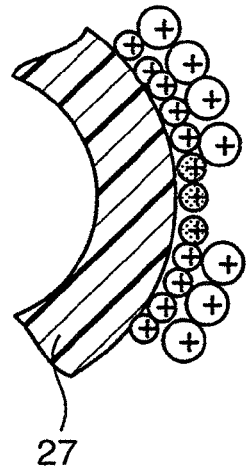
FIG. 6C (PRIOR ART)
FIG. 6C is a schematic view illustrating the behavior of the toner on the developing roller after flying of the toner from the developing roller 14 to the photosensitive drum in the conventional developing device 10.

In the developing device 10 of the present embodiment, the toner behaves in the manner shown in FIG. 6 on the developing roller 14. FIG. 6A is a schematic view illustrating the behavior of the toner on the developing roller in the developing device 10 of the present embodiment, before flying of the toner from the developing roller 14 to the photosensitive drum. FIG. 6B is a schematic view illustrating the behavior of the toner on the developing roller in the developing device 10 of the present embodiment after flying of the toner from the developing roller 14 to the photosensitive drum. FIG. 6B shows the developing roller after flying of the toner from the developing roller 14 to the photosensitive drum and before supply of the new toner from the agitating member 324. FIG. 6C is a schematic view illustrating the behavior of the toner on the developing roller in a conventional developing device 10 after flying of the toner from the developing roller 27 to the photosensitive drum.

As shown in FIGS. 6A and 6B, in the developing device 10 of the present embodiment, some particular toner in the toner carried on the developing roller 14 is seldom transferred and used preferentially on the photosensitive drum 301, prohibiting selective movement of the toner between the developing roller 14 and the photosensitive drum 301. Even after repeated image formation for an extended period of time, the toner carried on the developing roller 14 in the developing device 10 is seldom electrified locally, giving a uniformly charged toner. Because selective movement of the toner is restricted, small-diameter toner, which easily adheres to the developing roller, may be used for development. Thus, it is possible to obtain high-quality images for an extended period of time. In contrast, in the case of a conventional developing device, repeated image formation for an extended period of time results in deposition of the small-diameter toner higher in charge on the developing roller 27, prohibiting favorable development, as shown in FIG. 6C.

Second Embodiment

Figure 7:
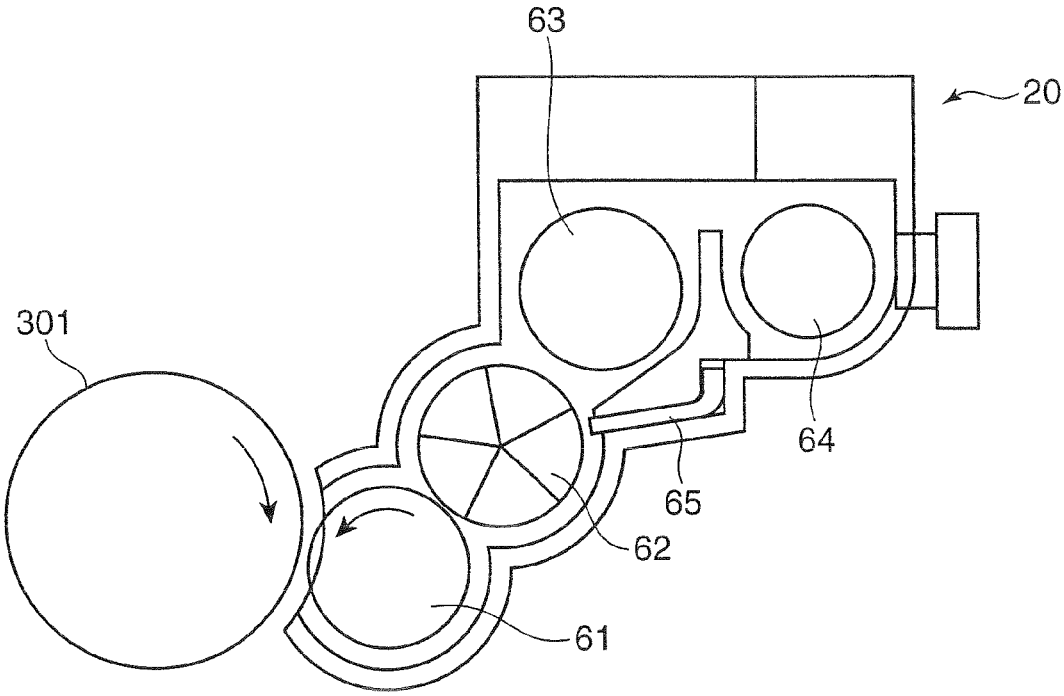
FIG. 7 is a schematic cross-sectional view illustrating the developing unit (developing device) 20 in the second embodiment of the present invention.

Hereinafter, the development device 20 in the second embodiment having a configuration modified from that of the developing device 10 in the first embodiment of the present invention, as shown in FIG. 7. FIG. 7 is a schematic cross-sectional view illustrating the developing unit (developing device) 20 described above, together with a photosensitive drum 301.

The developing device 20 is a developing device in the touchdown development process, and has, for example, a developing roller 61, a magnetic roller 62, agitating members 63 and 64, and a blade 65.

The agitating members 63 and 64 have helical blades, which charge the toner of the two-component developer, while conveying and agitating the two-component developer in the mutually opposite directions. The agitating member 63 supplies the two-component developer including the charged toner and the carrier to the magnetic roller 62.

The magnetic roller 62 conveys the two-component developer by attracting the two-component developer with the magnet contained therein. Then, the two-component developer is forced to has a shape similar to magnetic brush by the magnet in the magnetic roller 62, the thickness of the magnetic brush is controlled during passage of the magnetic brush between the blade 65 and the magnetic roller 62. The two-component developer toner conveyed close to the developing roller 61 is forced to transfer to the developing roller 61, by the potential difference generated between the developing roller 61 and the magnetic roller 62.

The developing roller 61 conveys the toner transferred from the magnetic roller 62, while carrying the toner on the surface. The toner conveyed close to the photosensitive drum 301 is driven to migrate to the photosensitive drum 301 by the potential difference generated between the photosensitive drum 301 and the developing roller 61.

In the operations above, the developing device 20 develops an image corresponding to the electrostatic latent image formed on the photosensitive drum 301. The development condition in the development device 20 in the second embodiment is, for example, as follows: The photosensitive drum 301 for use is a photosensitive drum having a diameter of 30 mm; the developing roller 61 for use is a developing roller having a diameter of 16 mm; the magnetic roller 62 for use is a developing roller having a diameter of 20 mm; and the peripheral speeds of the photosensitive drum 301, the developing roller 61 and the magnetic roller 62 are adjusted respectively to 147, 224 and 336 mm/sec. The gap between the photosensitive drum 301 and the developing roller 61 is adjusted to 200 μm, while the gap (MS gap) between the developing roller 61 and the magnetic roller to 62 to 330 μm. The latent image region (exposed region, image forming region) on the photosensitive drum 301 has an electric potential of 20 V, while the non-latent image region (unexposed region, non-image forming region) an electric potential of 350 V. The toner-supplying bias voltage (bias voltage applied to magnetic roller 62) is a superposed voltage obtained by superposing DC and AC voltages. Specifically, the DC voltage [Vdc (mag)] is set to 350 V. The peak-to-peak value [Vpp (mag)] of AC voltage is set to 1.55 kV; the AC frequency [f (mag)] to 3.5 kHz; the positive duty ratio [Duty (mag)] of AC voltage to 67%. The developing bias voltage (bias voltage applied to developing roller 61) is a superposed voltage obtained by superposing DC and AC voltages. Specifically, the DC voltage [Vdc (slv)] is set to 100 V. The peak-to-peak value [Vpp (slv)] of AC voltage is set to 0.4 kV; the AC frequency [f (slv)] to 4.5 kHz; and the positive duty ratio [Duty (slv)] of AC voltage to 33%.

Figure 8A:
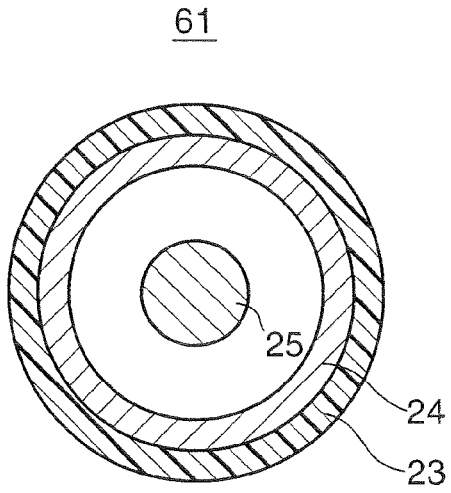
FIG. 8A is a cross-sectional view illustrating an example of the developing roller 61 installed in a developing device 20 of the touchdown development process.
Figure 8B:
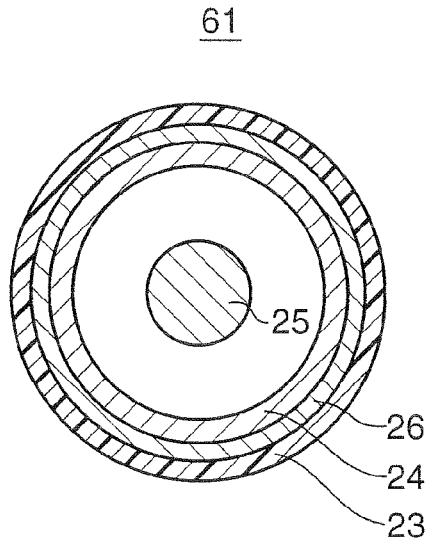
FIG. 8B is a cross-sectional view illustrating another example of the developing roller 61 installed in a developing device 20 of the touchdown development process.
Figure 8C:
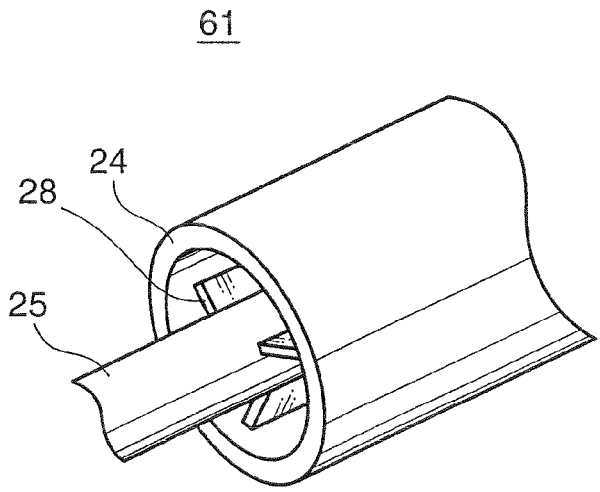
FIG. 8C is a perspective view illustrating the developing roller 61 installed in a developing device 20 of the touchdown development process.

Hereinafter, the developing roller 61 installed in the developing device 20 in the touchdown development process will be described. FIG. 8A is a cross-sectional view illustrating an example of the developing roller 61 installed in the developing device 20 in the touchdown development process. FIG. 8B is a cross-sectional view illustrating another example of the developing roller 61 installed in the developing device 20 in the touchdown development process. FIG. 8C is a perspective view illustrating the developing roller 61 installed in the developing device 20 in the touchdown development process.

The developing roller 61 has a main roller 24 and a resin layer 23 coated on the surface of the main roller 24. The main roller 24 is connected to a shaft 25 supported by the developing unit 10 with multiple ribs 28. The main roller 24 is, for example, a so-called three-point support cylinder of aluminum or stainless steel. The resin layer 23 for used may be a layer similar to the resin layer 18 in the first embodiment. A surface-finished layer 26 may be formed on the surface of the main roller 24, as shown in FIG. 8B. The surface-finished layer 26 for use may be a layer similar to the surface-finished layer 21 in the first embodiment.

Also in the case of the developing device 20 in the present embodiment, similarly to the case of the developing device 10 in the first embodiment some particular toner in the toner carried on the developing roller seldom migrates preferentially to the photosensitive drum for use in development, restricting selective migration of the toner between the developing roller and the photosensitive drum, as shown in FIGS. 6A and 6B.

The present invention is not limited to the first and second embodiments, if it is a developing device having an absolute value of the difference in charge between the toners in the upper and lower layers of 6 μC/g or less. A developing device in such a configuration is resistant to partial charge up of the toner carried on the developing roller 14, allowing narrower distribution in toner charge and preventing selective migration of the toner, and thus, permits use of a small-diameter toner, which easily deposits on the developing roller, for development and production of high-quality images for an extended period of time. Thus, the present invention is not particularly limited, if it is a developing device having an absolute value of the difference in charge between the toners in the upper and lower layers of 6 μC/g or less.

EXAMPLES

Hereinafter, an example of the developing device 20 in the second embodiment will be described.

The copying machine used in Examples and Comparative Examples is a conventional copying machine (KM-C3232, manufactured by Kyocera Mita Corp.) with its developing roller of developing device replaced with the following developing roller. In Examples 1 to 7 and Comparative Examples 2 to 4, the replaced developing roller is a developing roller having a resin layer on the surface shown in FIG. 5A, while in Comparative Example 1, it is a developing roller surface-treated with alumite.

The developing roller in Example 1 is prepared in the following manner:

[Preparation of Urethane Resin (A)]

First, a urethane resin (A) was prepared.

Specifically, 110 g (OH group: 0.074 mol) of a polyether diol having a vinyl group on the side chain represented by the following Formula (1) (molecular mass: 3000, n:m:o=30:50:20), 9.0 g (NCO group: 0.072 mol) of 4,4'-diphenylmethane diisocyanate, and 300 ml of methylisobutylketone were placed in 1 L flask equipped with a thermometer and a stirrer, and the mixture was dissolved by agitation.

FORMULA 1

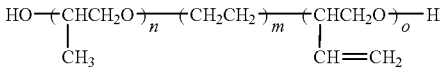

(1)

0.1 g of dibutyltin dilaurate was added thereto, and the mixture was allowed to react at 80° C. for 5 hours. The resin contained in the reaction solution was designated as urethane resin (A). The mass-average molecular mass of the urethane resin (A), as determined by GPC, was approximately 129,000.

In preparation of the following developing roller, a urethane resin solution diluted further with methylisobutylketone to a solid matter concentration of 20 mass % was used.

[Preparation of Developing Roller]

A developing roller was then prepared.

Specifically, first, 100 parts by mass of a silicon-containing compound (B), i.e., a milable silicone rubber compound (KE-971U, manufactured by Shin-Etsu Chemical Co., Ltd.) was blended with 0.6 part by mass of a crosslinking agent (C-8A, manufactured by Shin-Etsu Chemical Co., Ltd.) and 16 parts by mass of a conductivity-enhancing agent (D) of acetylene black having a primary particle diameter of 48 nm. A Pt complex catalyst was added to the silicone rubber blend as hydrosilylation catalyst (C), and the silicone rubber blend was coated on the surface of an alumite-surface-treated aluminum roller. Then, the urethane resin solution was coated additionally and dried after application under heat at 50 to 200° C. for 5 minutes to 2 hours.

The total coating amount of the silicone rubber blend and the urethane resin solution is an amount forming a resin layer having a thickness of 10 μm. The ratio in amount of the silicone rubber blend to the urethane resin solution coated is a blending rate of 50 parts by mass of the silicon-containing compound (B) with respect to 100 parts by mass of the urethane resin (A). The application method is not particularly limited, but, for example, screen printing, spray coating, dip coating or the like is preferable.

Examples 2 to 4 and Comparative Example 2 were carried out similarly to Example 1, except that the resin layer thickness was adjusted to that shown in Table 1. Examples 5 to 7 and Comparative Examples 3 and 4 were carried out similarly to Example 1, except that the blending rate of the silicon-containing compound (B) was that shown in Table 2. In Comparative Example 1, an aluminum roller surface-finished with alumite was used.

Figure 9:
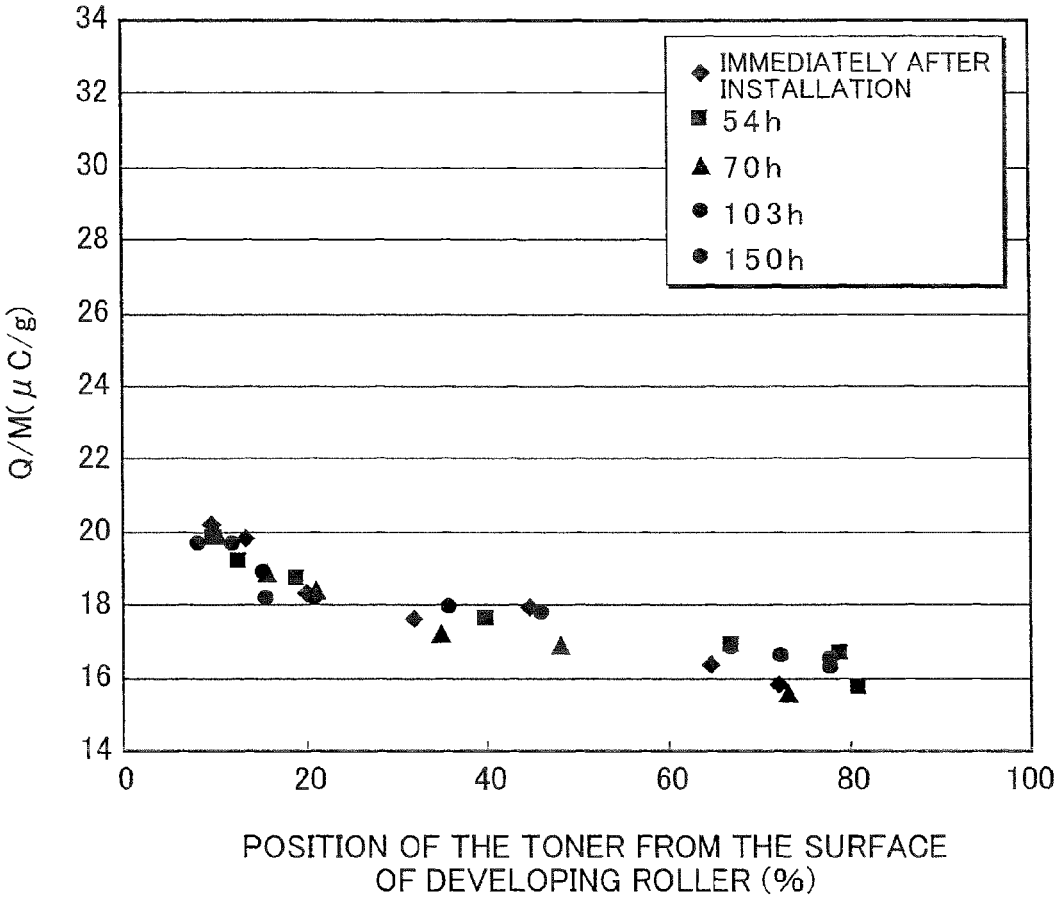
FIG. 9 is a graph showing the relationship between the position of the toner from the surface of the developing roller used in Example 1 and the charge on the toner.
Figure 10:
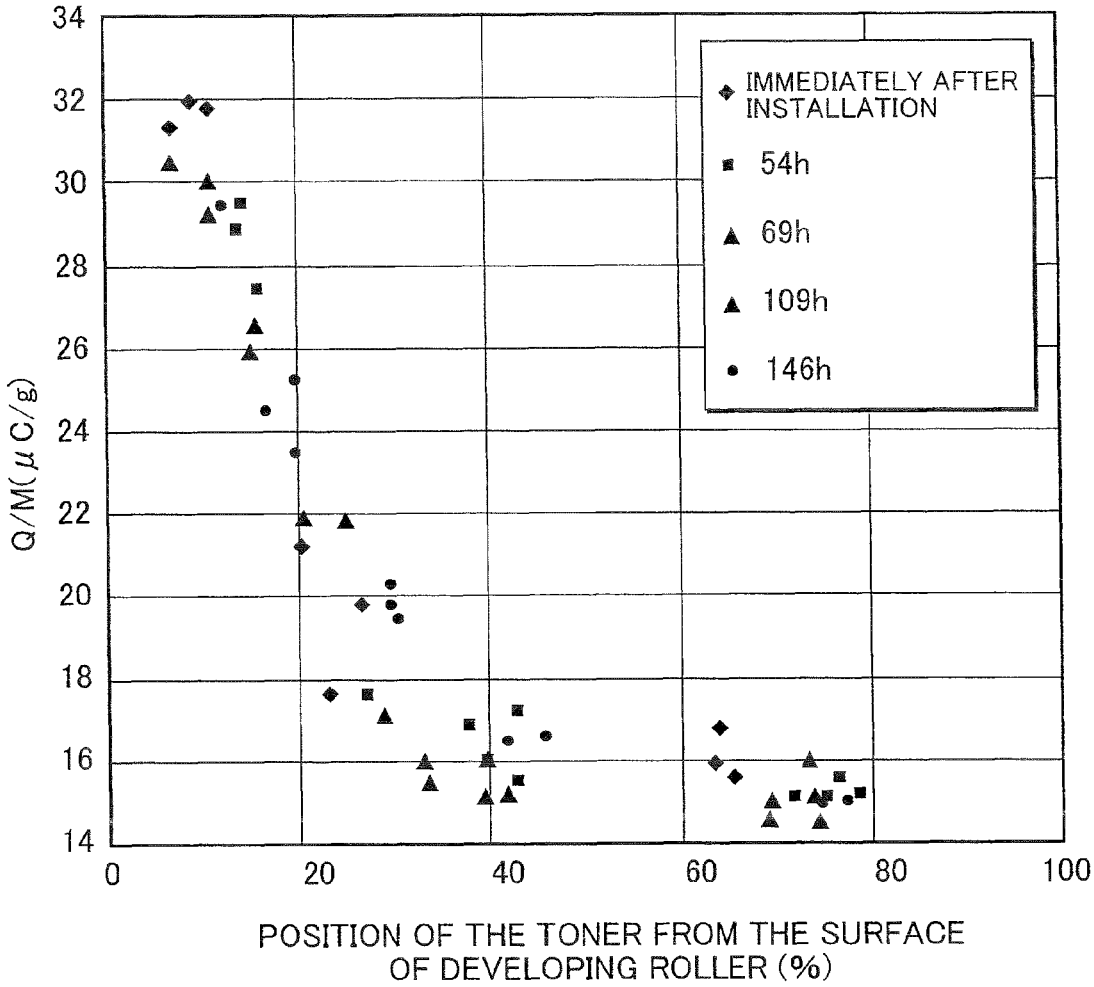
FIG. 10 is a graph showing the relationship between the position of the toner from the surface of the developing roller used in Comparative Example 1 and the charge on the toner.

FIG. 9 is a graph showing the relationship between the position of the toner from the surface of the developing roller used in Example 1 and the charge on the toner, and FIG. 10 is a graph showing the relationship between the position of the toner from the surface of the developing roller used in Comparative Example 1 and the charge on the toner.

The abscissa indicates the position of the toner from the surface of the developing roller surface (%), while the ordinate the charge on the toner (μC/g). The position of the toner from the developing roller surface (%) is the amount of the toner remaining deposited on the developing roller when the toner carried on the developing roller was removed from the toner layer surface by suction by using a QM meter (MODEL 210S) manufactured by TREK, in the entire toner initially carried on the developing roller. Thus, when the position of the toner (%) is smaller, the toner is closer to the developing roller (lower-layer toner), and when the position of the toner (%) is far larger, the toner is more separated from the developing roller (upper-layer toner). The toner layer used for measurement is the toner layer after stabilized operation of the developing device and after repeated printing of an image having a printing rate of 3% on 10 sheets (A4-sized).

Figure 11:
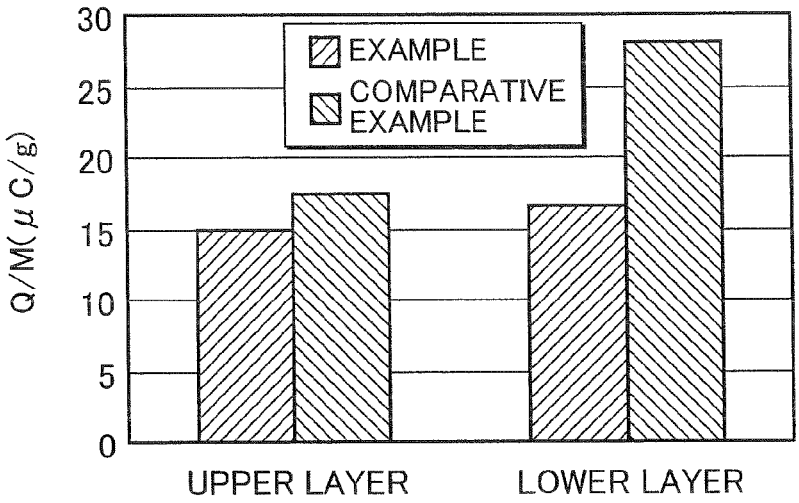
FIG. 11 shows the relationship between the charge of the upper-layer toner and that of the lower-layer toner.

FIG. 11 is a graph showing the relationship between the charge amounts of the upper- and lower-layer toners. Specifically, FIG. 11 shows the relationship between the charge of the upper- and lower-layer toners when the upper-layer toner is the toner in an amount in the range of 60 mass % with respect to the total amount of the toner carried on the developing roller.

As obvious from FIGS. 9 and 11, the absolute value of the difference in charge between the toners in the upper and lower layers was 6 μC/g or less in Example 1. In contrast in Comparative Example 1, as obvious from FIGS. 10 and 11, the absolute value of the difference in charge between the toners in the upper and lower layers is more than 6 μC/g.

Examples 1 to 7 and Comparative Examples 2 to 4 were evaluated by the methods described below.

The image densities IDs and fog densities FDs of an image immediately after initiation of printing of an image having a printing rate of 3% and an image printed after repeated printing of the image having a printing rate of 3% on 500 sheets were determined and evaluated according to the following criteria. Evaluation results are shown in Tables 1 and 2. The image density ID and the fog density FD were determined respectively by using a portable reflection densitometer RD-19 (manufactured by Gretag Macbeth).

(Image Density ID)

When the difference between the ID of the image after printing on 500 sheets and the ID of the image immediately after initiation of printing is a decrease of 0.03 or less, the copying machine was favorable and ranked as "A". In contrast, when the ID of the image after printing on 500 sheets is smaller than the ID of the image immediately after initiation of printing by 0.03 or more, the copying machine was ranked as "B".

(Fog Density FD)

When the FD of the image after printing on 500 sheets is larger than the FD of the image immediately after initiation of printing by less than 0.004, the copying machine was favorable and ranked as "A". In contrast when the FD of the image after printing on 500 sheets is larger than the FD of the image immediately after initiation of printing by 0.004 or more, the copying machine was unfavorable and evaluated as "B".

TABLE 1

| | | | CHARGE ON TONER(μC/g) | | | | | |
|---|---|---|---|---|---|---|---|---|
| | | | IMMEDIATELY AFTER INITIATION OF PRINTING | | | | | |
| | RESIN LAYER THICKNESS (μm) | BLENDING RATE OF SILICON COMPOUND (B) (PARTS BY MASS) | UPPER LAYER | LOWER LAYER | DIFFERENCE BETWEEN UPPER AND LOWER LAYERS | ENTIRE LAYER | AFTER PRINTING ON 500 SHEETS | VOLUME RESISTANCE (Ω) |
| EXAMPLE 1 | 10 | 50 | 18.0 | 19.7 | 1.7 | 18.5 | 19.2 | $1 \times 10^8$ |
| EXAMPLE 2 | 20 | 50 | 18.5 | 21.5 | 3.0 | 19.4 | 20.4 | $9 \times 10^8$ |
| EXAMPLE 3 | 5 | 50 | 18.0 | 18.3 | 0.3 | 18.1 | 18.3 | $1 \times 10^6$ |
| EXAMPLE 4 | 30 | 50 | 18.7 | 24.4 | 5.7 | 20.4 | 22.5 | $1 \times 10^7$ |
| COMPARATIVE EXAMPLE 2 | 35 | 50 | 18.0 | 28.0 | 10.0 | 21.0 | 25.1 | $1 \times 10^8$ |

| | EVALUATION | | | | | | | |
|---|---|---|---|---|---|---|---|---|
| | ID | | | | FD | | | |
| | IMMEDIATELY AFTER INITIATION OF PRINTING | AFTER PRINTING ON 500 SHEETS | DIFFERENCE BETWEEN IMMEDIATELY AFTER INITIATION OF PRINTING AND AFTER PRINTING ON 500 SHEETS | | IMMEDIATELY AFTER INITIATION OF PRINTING | AFTER PRINTING ON 500 SHEETS | DIFFERENCE BETWEEN IMMEDIATELY AFTER INITIATION OF PRINTING AND AFTER PRINTING ON 500 SHEETS | |
| EXAMPLE 1 | 1.452 | 1.448 | 0.004 | A | 0.001 | 0.001 | 0.000 | A |
| EXAMPLE 2 | 1.441 | 1.432 | 0.009 | A | 0.001 | 0.002 | 0.001 | A |
| EXAMPLE 3 | 1.452 | 1.450 | 0.002 | A | 0.001 | 0.001 | 0.000 | A |
| EXAMPLE 4 | 1.422 | 1.401 | 0.021 | A | 0.001 | 0.004 | 0.003 | A |
| COMPARATIVE EXAMPLE 2 | 1.410 | 1.358 | 0.052 | B | 0.001 | 0.006 | 0.005 | B |

TABLE 2

| | | | CHARGE ON TONER(μC/g) | | | | |
|---|---|---|---|---|---|---|---|
| | | | IMMEDIATELY AFTER INITIATION OF PRINTING | | | | |
| | RESIN LAYER THICKNESS (μm) | BLENDING RATE OF SILICON COMPOUND (B) (PARTS BY MASS) | UPPER LAYER | LOWER LAYER | DIFFERENCE BETWEEN UPPER AND LOWER LAYERS | ENTIRE LAYER | AFTER PRINTING ON 500 SHEETS |
| EXAMPLE 1 | 10 | 50 | 18.0 | 19.7 | 1.7 | 18.5 | 19.2 |
| EXAMPLE 5 | 10 | 1 | 18.3 | 20.0 | 1.7 | 18.8 | 21.5 |
| EXAMPLE 6 | 10 | 0.1 | 18.4 | 20.7 | 2.3 | 19.1 | 22.4 |
| EXAMPLE 7 | 10 | 100 | 18.4 | 20.4 | 2.0 | 19.0 | 22.1 |
| COMPARATIVE EXAMPLE 3 | 10 | 0 | 18.8 | 26.1 | 7.3 | 21.0 | 28.2 |
| COMPARATIVE EXAMPLE 4 | 10 | 110 | 20.1 | 26.4 | 6.3 | 22.0 | 27.5 |

TABLE 2-continued

| | EVALUATION | | | | | | | |
|---|---|---|---|---|---|---|---|---|
| | ID | | | | FD | | | |
| | IMMEDIATELY AFTER INITIATION OF PRINTING | AFTER PRINTING ON 500 SHEETS | DIFFERENCE BETWEEN IMMEDIATELY AFTER INITIATION OF PRINTING AND AFTER PRINTING ON 500 SHEETS | | IMMEDIATELY AFTER INITIATION OF PRINTING | AFTER PRINTING ON 500 SHEETS | DIFFERENCE BETWEEN IMMEDIATELY AFTER INITIATION OF PRINTING AND AFTER PRINTING ON 500 SHEETS | |
| EXAMPLE 1 | 1.452 | 1.448 | 0.004 | A | 0.001 | 0.001 | 0.000 | A |
| EXAMPLE 5 | 1.437 | 1.425 | 0.012 | A | 0.001 | 0.001 | 0.000 | A |
| EXAMPLE 6 | 1.423 | 1.410 | 0.013 | A | 0.001 | 0.001 | 0.000 | A |
| EXAMPLE 7 | 1.431 | 1.401 | 0.030 | A | 0.001 | 0.001 | 0.000 | A |
| COMPARATIVE EXAMPLE 3 | 1.364 | 1.311 | 0.053 | B | 0.001 | 0.001 | 0.000 | A |
| COMPARATIVE EXAMPLE 4 | 1.424 | 1.387 | 0.037 | B | 0.001 | 0.001 | 0.000 | A |

As obvious from Tables 1 and 2, use of any one of the copying machines in Examples 1 to 7 lead to almost no decrease in image density ID and almost no increase in fog density FD, even after repeated printing for an extended period of time. In contrast, use of any one of the copying machines in Comparative Examples 2 to 4 resulted in deterioration in image density IG after repeated printing for an extended period of time. In addition, use of the copying machine in Comparative Example 2 resulted in increase in image density ID and also in fog density FD after repeated printing. Accordingly, use of the copying machines in Examples 1 to 7 resulted in no deterioration in image density and also no generation of fog even after repeated printing for an extended period of time, while use of copying machines in Comparative Examples 2 to 4 resulted in deterioration in image density and generation of fog after repeated printing for an extended period of time, prohibiting printing of high-quality image.

The results indicate that the copying machines in Examples wherein the absolute value of the difference in charge between the toners in the upper and lower layers is 6 μC/g or less allow repeated printing of high-quality image over an extended period of time. In contrast, the copying machines in Comparative Examples wherein the absolute value of the difference in charge between the toners in the upper and lower layers is more than 6 μC/g prohibit repeated printing of high-quality image over an extended period of time.

As described above, it is probably because, in the present Examples, the toner carried on the developing roller is seldom charged up partially and is narrower in toner charge distribution in the upper and lower toner layers and a small-diameter toner, which easily deposits on the developing roller, is also used for development. In contrast in the case of Comparative Example, repeated image formation for an extended period of time lead to deposition of the highly charged small-diameter toner on the developing roller, prohibiting favorable development.

The difference above is also supported by the following facts.

Figure 12:
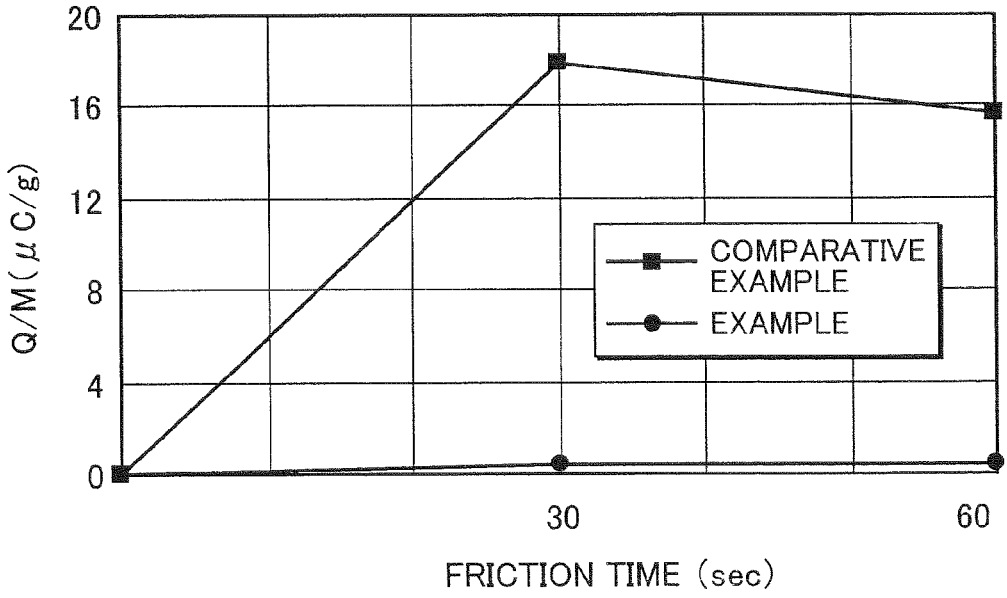
FIG. 12 is a graph showing the relationship between the friction time and the charge generated when the developing roller is rubbed.

FIG. 12 is a graph showing the relationship between the friction time and the charge on the toner when the resin coated on the developing roller surface was rubbed with the toner. The abscissa indicates the friction time, while the ordinate the charge of the resin then.

Figure 13:
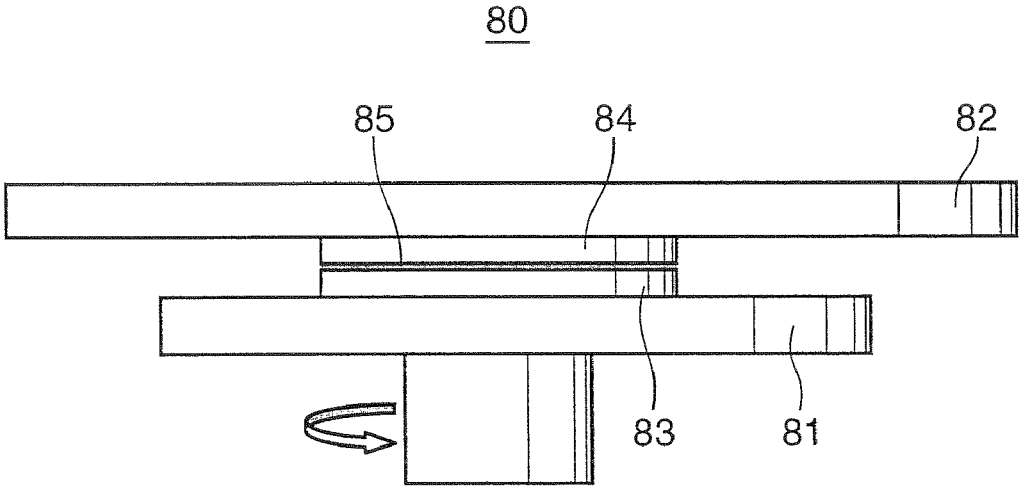
FIG. 13 is a schematic view illustrating a device 80 measuring the charge on resin.

The resin charge is determined in the following manner: FIG. 13 is a schematic view illustrating the device 80 for measuring the charge on the resin. The device 80 for measuring the resin charge has a revolving plate 81 and a supporting plate 82.

First, two sample plates 83 and 84 carrying on one face the resin to be coated on the developing roller surface are prepared. One sample plate 83 is fixed in the central region of the revolving plate 81, while the other sample plate 84 in the central region of the supporting plate 82. Two to four mg of the toner 85 is placed on the sample plate 83 on the revolving plate 81, and the supporting plate 82 was placed thereon, holding the toner 85 between the revolving plate 81-sided sample plate 83 and the supporting plate 82-sided sample plate 84. The revolving plate 81-sided sample plate 83 and the supporting plate 82-sided sample plate 84 are installed with the resin-coated faces in contact with or in close proximity to the toner 85. The revolving plate 81 was rotated as the supporting plate 82 is fixed, and the charge generated on the resins of the sample plates 83 and 84 are determined at a particular time interval.

The revolving plate 81 is a circular plate having a diameter of 100 mm, while the supporting plate is a circular aluminum plate (700 g) having a diameter of 100 mm. The sample plates 83 and 84 are square plates having a base of 50 mm in length. The revolving plate is rotated at a frequency of 250 rpm.

As obvious from FIG. 12, the resins used for coating the developing rollers in Examples did not show increase in surface charge even when the resins were rubbed with the toner, while the resins used for coating the developing rollers in Comparative Examples showed increase in surface charge when rubbed with the toner.

Figure 14:
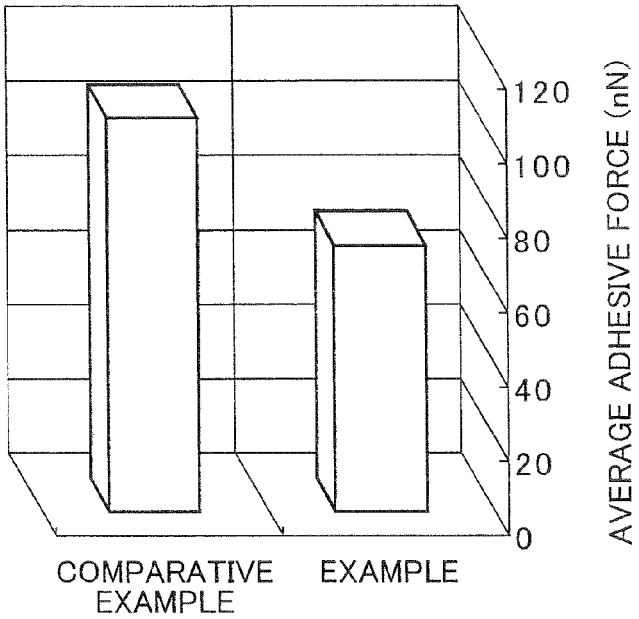
FIG. 14 is a graph showing the adhesive force of the toner in the toner layer formed on the developing roller to the developing roller.

FIG. 14 is a graph showing the adhesive force of the toner in the toner layer formed on the developing roller to the developing roller. The average adhesive force of the toner F50 was determined by using a centrifugal adhesive force analyzer NS-C100 (Nano Seeds Corp.) in the following manner. The toner layer used for measurement was the toner layer after stabilized operation of the developing device and after repeated printing of an image having a printing rate of 3% on 10 sheets (A4-sized).

First, a toner is deposited on a particular base plate, and an image of the base plate is taken under the microscope attached to the centrifugal adhesive force analyzer. The base plate is then fixed to the centrifuge attached to the centrifugal adhesive force analyzer and rotated under application of a particular centrifugal force (e.g., 2000 G). Then, the image of the base plate is taken under the microscope. Rotation at a different centrifugal force and photographing are repeated, giving multiple images for storage. The area of the base plate carrying the deposited toner is calculated by processing of the multiple images obtained with an analytical tool, and the average adhesive force F50 is calculated from the area.

As obvious from FIG. 14, the developing roller used in Example had a toner adhesive force lower than that of the developing roller used in Comparative Example.

Figure 15:
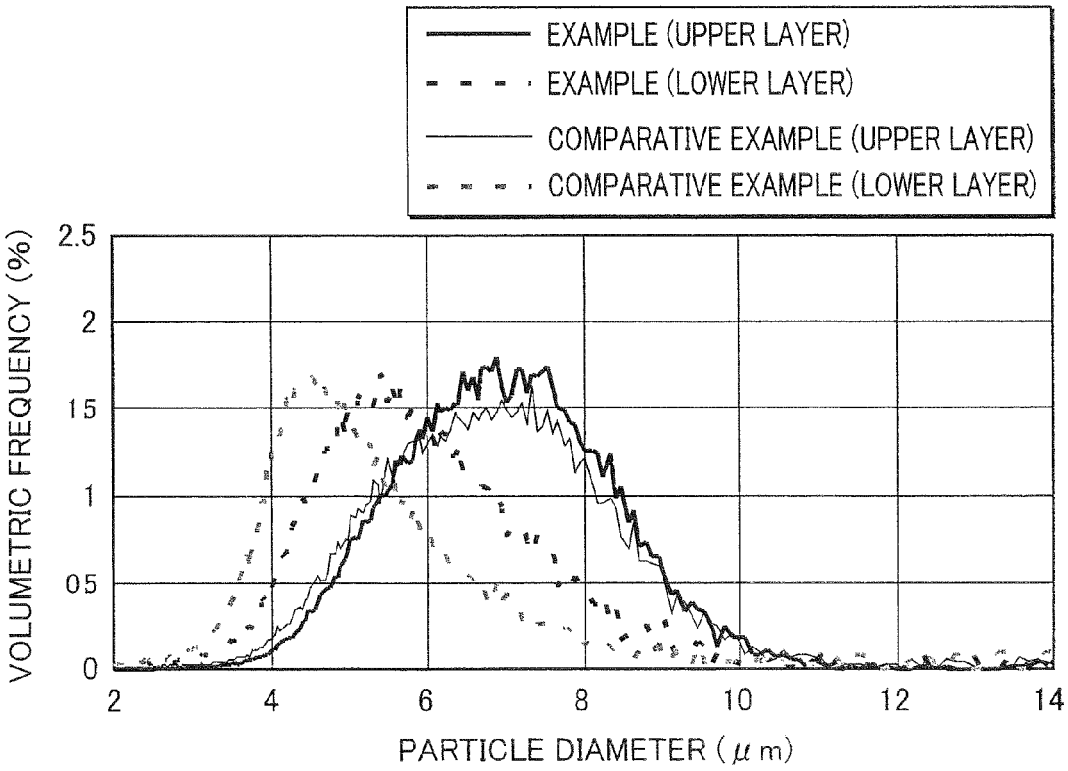
FIG. 15 is a graph showing the particle size distribution of the toner on the developing roller.

FIG. 15 is a graph showing the particle size distribution of the toner deposited on the developing roller. The particle size distribution was determined by using Multisizer III (manufactured by Beckmann Coulter) under the measuring condition of an aperture diameter of 100 μm (measurement range: 2.0 to 60 μm). Used for measurement was the toner layer after stabilized operation of the developing device and after repeated printing of an image having a printing rate of 3% on 10 sheets (A4-sized). The upper-layer toner is the toner in an amount of 60 mass % from the surface in the entire toner carried on the developing roller, and the lower-layer toner is the toner closer to the developing roller than the upper-layer toner.

As obvious from FIG. 15, the toner on the developing roller used in the Example has a smaller difference in particle diameter between the toners in the upper- and lower-layer, compared to that in the Comparative Example.

As obvious from the results in FIGS. 12, 14, and 15, there was almost no deposition of the charged-up small-diameter toner preferentially on the developing roller in the present Example, allowing use of a small-diameter toner, which easily deposits on the developing roller, for development, seemingly because the developing roller is charged weakly and the toner is less adhesive to the developing roller.

As described above in detail, an aspect of the present invention is a developing device visualizing an electrostatic latent image previously formed on the surface of an image carrier as toner image, comprising: a developing roller placed at a position facing the image carrier, carrying a toner on the surface thereof, conveying the toner; and flying the conveyed toner onto the surface of the image carrier; and a resin layer coated on the surface of the developing roller, wherein the absolute value of the difference in charge between the toners in the upper and lower layers of the toner layer formed on the developing roller as the toner is carried on the developing roller is 6 μC/g or less.

In the configuration, some particular toner in the toner carried on the developing roller is seldom transferred preferentially onto the image carrier for use in development, prohibiting the selective movement of the toner between the developing roller and the image carrier. The toner carried on the developing roller is hardly charged up partially even when image forming is repeated for an extended period of time in the developing device, and the distribution of toner charge in the upper and lower toner layers is narrower. In addition, restriction of selective movement of the toner leads to effective use of the charged-up small-diameter toners, which easily deposits on the developing roller, in development. Thus, it is possible to obtain high-quality images over an extended period of time.

The upper-layer toner is preferably the toner carried on the developing roller in an amount in the range of 50 to 70 mass % from the surface in the entire toner. Conventional developing devices often have large difference in charge between the upper-layer toner in the range above and the lower-layer toner located to the developing roller side of the upper layer. Thus, smaller difference in the charge favorably leads to narrower distribution in charge of the toner carried on the developing roller.

The resin is preferably a silicone-modified urethane resin. In this way, it is possible to reduce the distribution in charge on the toner carried on the developing roller easily.

The resin is preferably a hardened product of a resin composition containing a urethane resin having at least one alkenyl group allowing hydroxylation reaction in the molecule and a silicon-containing compound having at least two hydroxyl groups in the molecule.

The resin preferably contains a carbon-based conductive material. In this way, it is possible to reduce the difference in charge between the toner and the surface layer resin of the developing roller and to prevent partial charge up of the toner more effectively.

The resin preferably has a volume resistivity in the range of $10^5$ to $10^7$μ. It is possible in this way to reduce the difference in charge between the toner and the surface layer resin of the developing roller and to prevent partial charge up of the toner more effectively.

Also preferably, the developing roller has a cylindrical revolving sleeve and a fixed magnet enclosed in the revolving sleeve, and the revolving sleeve has a base plate and a resin layer coated on the base material, the base plate has a surface-finished layer on the surface to carry the resin layer.

It is possible to reduce the absolute value of the difference in charge between the toners in the upper and lower layers by forming a surface-finished layer even when the resin layer is thinned, compared to the case where no surface-finished layer is formed.

Another aspect of the present invention is a developing device visualizing an electrostatic latent image previously formed on the surface of an image carrier as toner image, comprising: a magnetic roller carrying and conveying a two-component developer containing a toner and a carrier; a developing roller placed at a position facing the image carrier and the magnetic roller that carries the toner in the two-component developer on the surface in contact with or in close proximity to the two-component developer conveyed by the magnetic roller, conveys and flies the conveyed toner onto the surface of the image carrier; and a resin layer coated on the surface of the developing roller, wherein the absolute value of the difference in charge between the toners in the upper and lower layers of the toner layer formed on the developing roller as the toner is carried on the developing roller is 6 μC/g or less.

In the configuration, some particular toner in the toner carried on the developing roller is seldom transferred preferentially onto the image carrier for use in development, prohibiting selective transfer the toner between the developing roller and the image carrier. The toner carried on the developing roller is hardly charged up partially even when image forming is repeated for an extended period of time in the developing device, and the distribution in charge on the toners in the upper and lower layers is narrower. In addition, restriction of selective movement of the toner leads to effective use of charged-up small-diameter toners, which easily deposits on the developing roller, in development. Thus, it is possible to obtain high-quality images over an extended period of time.

Yet another aspect of the present invention is an image forming apparatus; comprising: an image carrier forming an electrostatic latent image thereon, a developing roller placed at a position facing the image carrier, carrying a toner on the surface thereof, conveying the toner, and flying the conveyed toner onto the surface of the image carrier; and a resin layer coated on the surface of the developing roller, wherein the absolute value of the difference in charge between the toners in the upper and lower layers of the toner layer formed on the developing roller as the toner is carried on the developing roller is 6 μC/g or less.

In the configuration, the image forming apparatus shows the advantageous effects of the developing device above, and thus, high-quality images are formed therein repeatedly over an extended period of time.

This application is based on Japanese Patent application serial No. 2007-320654 filed in Japan Patent Office on Dec. 12, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device visualizing an electrostatic latent image previously formed on the surface of an image carrier as toner image, comprising:

a developing roller placed at a position facing the image carrier, carrying a toner on the surface thereof, conveying the toner, and flying the conveyed toner onto the surface of the image carrier; and a resin layer coated on the surface of the developing roller, wherein an absolute value of a difference in charge between toners in upper and lower layers of a toner layer formed on the developing roller as the toner is carried on the developing roller is 6 μC/g or less.

2. The developing device according to claim 1, wherein the upper-layer toner is the toner carried on the developing roller in an amount in the range of 50 to 70 mass % from the surface in the entire toner.

3. The developing device according to claim 1, wherein the resin is a silicone-modified urethane resin.

4. The developing device according to claim 3, wherein the resin is a hardened product of a resin composition containing a urethane resin having at least one alkenyl group allowing hydroxylation reaction in the molecule and a silicon-containing compound having at least two hydroxyl groups in the molecule.

5. The developing device according to claim 1, wherein the resin contains a carbon-based conductive material.

6. The developing device according to claim 1, wherein the resin has a volume resistivity in the range of $10^5$ to $10^7\Omega$.

7. The developing device according to claim 1, wherein:

the developing roller has a cylindrical revolving sleeve and a fixed magnet enclosed in the revolving sleeve;

the revolving sleeve has a base plate and a resin layer coated on the base plate; and the base plate has a surface-finished layer on the surface to carry the resin layer.

8. A developing device visualizing an electrostatic latent image previously formed on the surface of an image carrier as toner image, comprising:

a magnetic roller carrying and conveying a two-component developer containing a toner and a carrier;

a developing roller placed at a position facing the image carrier and the magnetic roller that carries the toner in the two-component developer on the surface or in close proximity to the two-component developer conveyed by the magnetic roller, conveys and flies the conveyed toner onto the surface of the image carrier; and a resin layer coated on the surface of the developing roller, wherein an absolute value of a difference in charge between toners in upper and lower layers of a toner layer formed on the developing roller as the toner is carried on the developing roller is 6 μC/g or less.

9. The developing device according to claim 8, wherein the upper-layer toner is the toner carried on the developing roller in an amount in the range of 50 to 70 mass % from the surface in the entire toner.

10. The developing device according to claim 8, wherein the resin is a silicone-modified urethane resin.

11. The developing device according to claim 10, wherein the resin is a hardened product of a resin composition containing a urethane resin having at least one alkenyl group allowing hydroxylation reaction in the molecule and a silicon-containing compound having at least two hydroxyl groups in the molecule.

12. The developing device according to claim 8, wherein the resin contains a carbon-based conductive material.

13. The developing device according to claim 8, wherein the resin has a volume resistivity in the range of $10^5$ to $10^7\Omega$.

14. The developing device according to claim 8, wherein:

the developing roller has a cylindrical revolving sleeve and a fixed magnet enclosed in the revolving sleeve;

the revolving sleeve has a base plate and a resin layer coated on the base plate; and the base plate has a surface-finished layer on the surface to carry the resin layer.

15. An image forming apparatus; comprising:

an image carrier forming an electrostatic latent image thereon;

a developing roller placed at a position facing the image carrier, carrying a toner on the surface thereof, conveying the toner, and flying the conveyed toner onto the surface of the image carrier; and a resin layer coated on the surface of the developing roller, wherein an absolute value of a difference in charge between toners in upper and lower layers of a toner layer formed on the developing roller as the toner is carried on the developing roller is 6 μC/g or less.

16. The image forming apparatus according to claim 15, wherein the upper-layer toner is the toner carried on the developing roller in an amount in the range of 50 to 70 mass % from the surface in the entire toner.

17. The image forming apparatus according to claim 15, wherein the resin is a silicone-modified urethane resin.

18. The image forming apparatus according to claim 17, wherein the resin is a hardened product of a resin composition containing a urethane resin having at least one alkenyl group allowing hydroxylation reaction in the molecule and a silicon-containing compound having at least two hydroxyl groups in the molecule.

19. The image forming apparatus according to claim 15, wherein the resin contains a carbon-based conductive material.

20. The image forming apparatus according to claim 15, wherein the resin has a volume resistivity in the range of $10^5$ to $10^7\Omega$.

21. The image forming apparatus according to claim 15, wherein;

the developing roller has a cylindrical revolving sleeve and a fixed magnet enclosed in the revolving sleeve;

the revolving sleeve has a base plate and a resin layer coated on the base plate; and the base plate has a surface-finished layer on the surface to carry the resin layer.

* * * * *